US008613499B2

(12) United States Patent
Miyazawa

(10) Patent No.: US 8,613,499 B2
(45) Date of Patent: Dec. 24, 2013

(54) INKJET HEAD AND MANUFACTURING METHOD OF INKJET HEAD

(75) Inventor: Toshio Miyazawa, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 93 days.

(21) Appl. No.: 13/220,487

(22) Filed: Aug. 29, 2011

(65) Prior Publication Data

US 2012/0050413 A1 Mar. 1, 2012

(30) Foreign Application Priority Data

Sep. 1, 2010 (JP) ..... 2010-196024

(51) Int. Cl.
*B41J 2/045* (2006.01)

(52) U.S. Cl.
USPC ..... 347/69; 347/50; 347/71

(58) Field of Classification Search
USPC ..... 347/69, 50, 71
See application file for complete search history.

(56) References Cited

U.S. PATENT DOCUMENTS

| | | | |
|---|---|---|---|
| 6,725,543 | B2 | 4/2004 | Sarojiniamma et al. |
| 6,959,471 | B2 | 11/2005 | Temple et al. |
| 7,597,428 | B2 | 10/2009 | Tanuma |
| 2008/0036823 | A1 | 2/2008 | Tanuma |

FOREIGN PATENT DOCUMENTS

| | | | | |
|---|---|---|---|---|
| JP | 0725010 | A | 1/1995 | |
| JP | 0825638 | A | 1/1996 | |
| JP | 2002-529289 | | 9/2002 | |
| JP | 2003-182087 | * | 7/2003 | ..... B41J 2/16 |
| JP | 2005138445 | A | 6/2005 | |
| JP | 2007313707 | A | 12/2007 | |

OTHER PUBLICATIONS

Japanese Office Action dated Sep. 11, 2012 for corresponding Japan Patent Application 2010-196024, 10 pages.

* cited by examiner

*Primary Examiner* — Henok Legesse
(74) *Attorney, Agent, or Firm* — Patterson & Sheridan, L.L.P.

(57) ABSTRACT

According to one embodiment, an inkjet head includes a nozzle plate, a piezoelectric member, a substrate, a frame member, and a wiring circuit. The nozzle plate has nozzles. The piezoelectric member has pressure chambers associated with the nozzles, sidewalls configured to pressurize the pressure chambers, and electrode wiring lines that are connected to electrodes provided on the respective sidewalls and alternately provided on one of both end sides of each of the pressure chambers which is different from the end side of respective adjacent pressure chambers. Further, the piezoelectric member applies a drive pulse voltage to the sidewalls from the electrodes to pressurize the pressure chambers. The piezoelectric member is bonded to the substrate. The frame member is bonded to the substrate and the nozzle plate to surround the piezoelectric member. The wiring circuit is provided on the substrate and has the electrode wiring lines.

2 Claims, 6 Drawing Sheets

INKJET HEAD AND MANUFACTURING METHOD OF INKJET HEAD

CROSS-REFERENCE TO RELATED APPLICATIONS

This application is based upon and claims the benefit of priority from prior Japanese Patent Application No. 2010-196024, filed on Sep. 1, 2010, the entire contents of which are incorporated herein by reference.

FIELD

Embodiments described herein relate generally to an inkjet head and a manufacturing method of an inkjet head.

BACKGROUND

As an apparatus that outputs data such as symbols or images, an inkjet printer has been conventionally known. In such a printer, an inkjet head that discharges fine ink drops onto a sheet type recording medium such as a paper sheet is used.

Such an inkjet head is electrically connected to an external circuit, e.g., a control unit of a printer. The inkjet head changes volumes of pressure chambers provided in a piezoelectric member based on an instruction from the external circuit to discharge an ink.

Such an inkjet head has electrodes of the piezoelectric member and a wiring circuit that connect the piezoelectric member to the external circuit. The electrodes and the wiring circuit are configured by forming a metal film on upper surfaces of the piezoelectric member and a substrate and patterning an electrically insulated portion in this metal film by using a laser patterning method or an etching method.

DETAILED DESCRIPTION

In general, according to one embodiment, an inkjet head comprises a nozzle plate, a piezoelectric member, a substrate, a frame member, and a wiring circuit. The nozzle plate comprises nozzles. The piezoelectric member comprises pressure chambers associated with the nozzles, sidewalls configured to pressurize the pressure chambers, and electrode wiring lines that are connected to electrodes provided on the respective sidewalls and alternately provided on one of both end sides of each of the pressure chambers which is different from the end side of respective adjacent pressure chambers. Further, the piezoelectric member applies a drive pulse voltage to the sidewalls from the electrodes to pressurize the pressure chambers, thereby discharging a liquid from the nozzles. The piezoelectric member is bonded to the substrate. The frame member is bonded to the substrate and the nozzle plate to surround the piezoelectric member, thereby forming a liquid chamber from which the liquid is supplied to the pressure chambers. The wiring circuit is provided on the substrate and comprises the electrode wiring lines.

Figure 1:
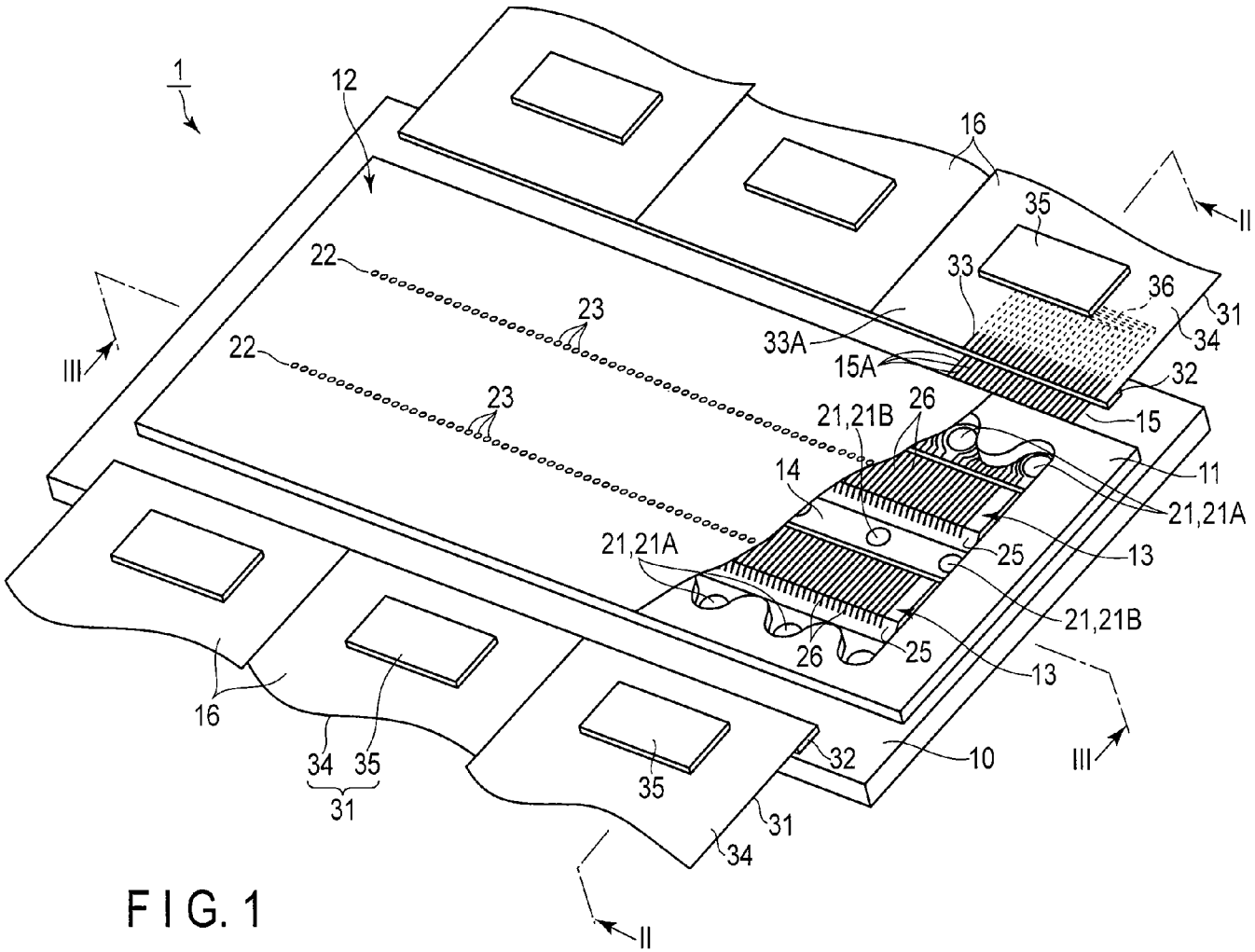
FIG. 1 is a perspective view showing a configuration of an inkjet head according to a first embodiment.

Embodiment of an inkjet head and a method for manufacturing the same will now be described in detail with reference to FIG. 1 to FIG. 10. FIG. 1 is a partially cutaway perspective view showing a configuration of the inkjet head 1 according to an embodiment, FIG. 2 is a cross-sectional view showing the configuration of the inkjet head 1 taken along line II-II in FIG. 1, FIG. 3 is a cross-sectional view schematically showing the configuration of the inkjet head 1 taken along line III-III in FIG. 1, and FIG. 4 is a perspective view schematically showing configurations of a piezoelectric member 13 and a wiring circuit 15 in the inkjet head 1.

Figure 5:
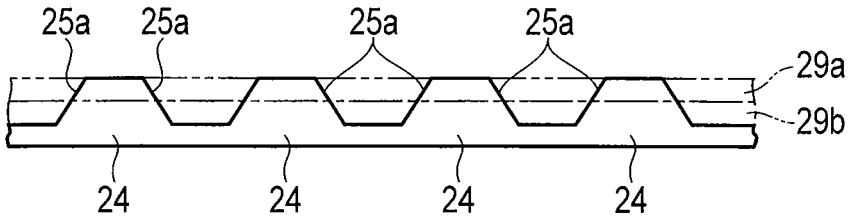
FIG. 5 is a side elevation schematically showing a step in manufacture of the inkjet head.
Figure 6:
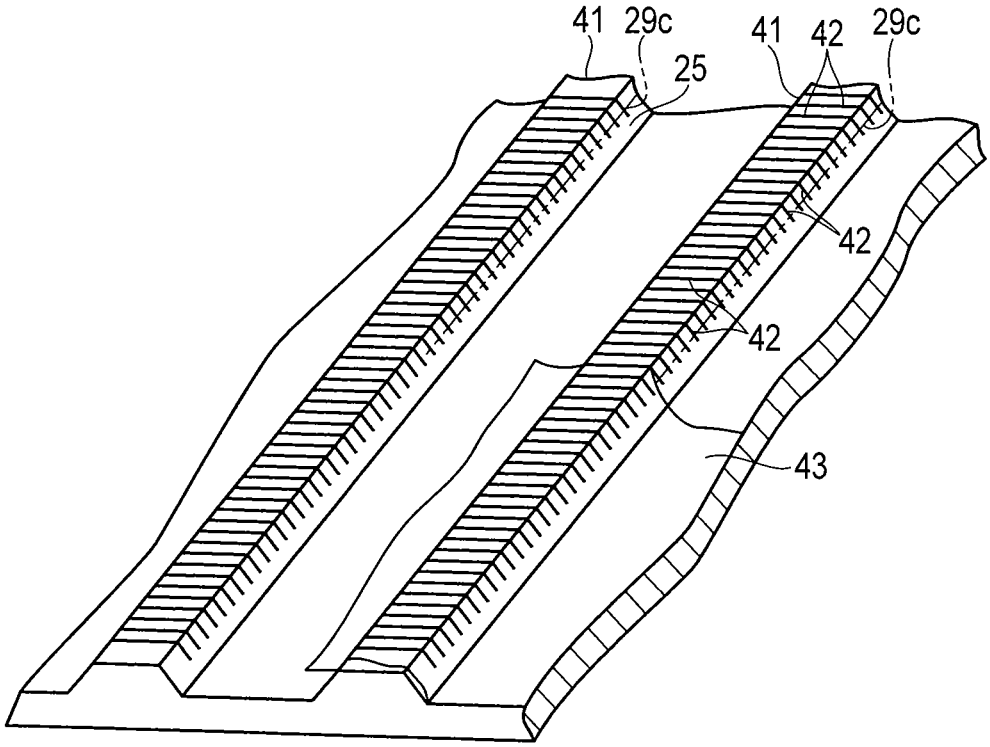
FIG. 6 is a perspective view schematically showing a step in the manufacture of the inkjet head.
Figure 7:
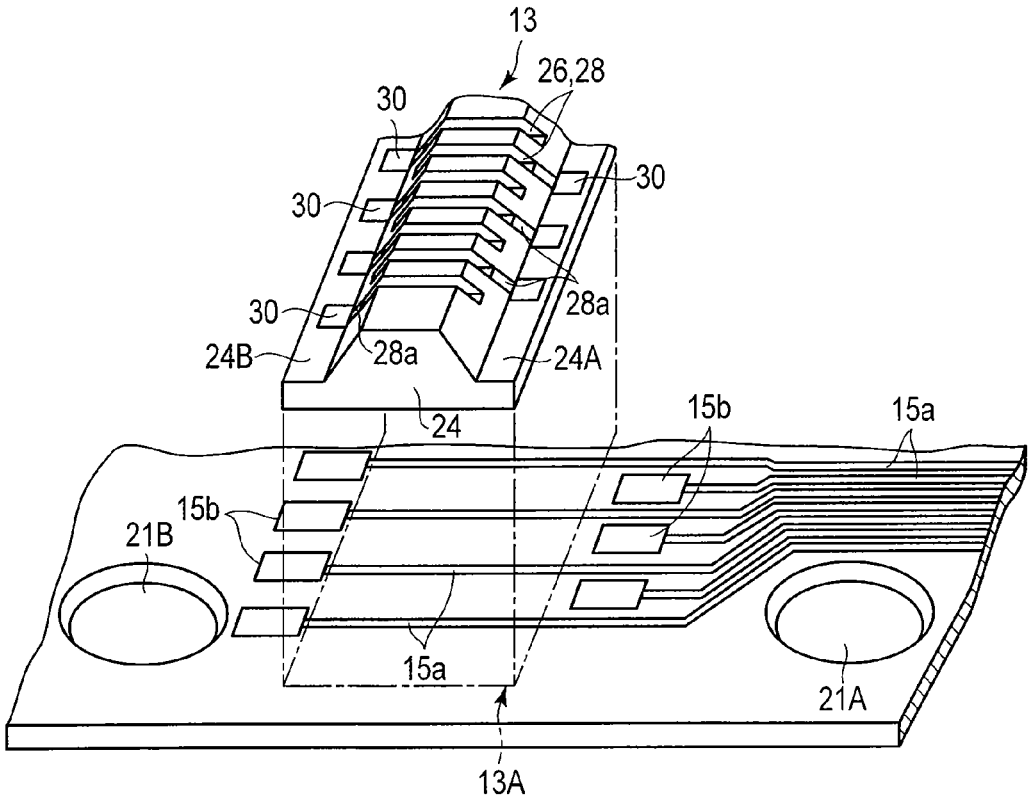
FIG. 7 is a perspective view schematically showing a step in the manufacture of the inkjet head.
Figure 8:
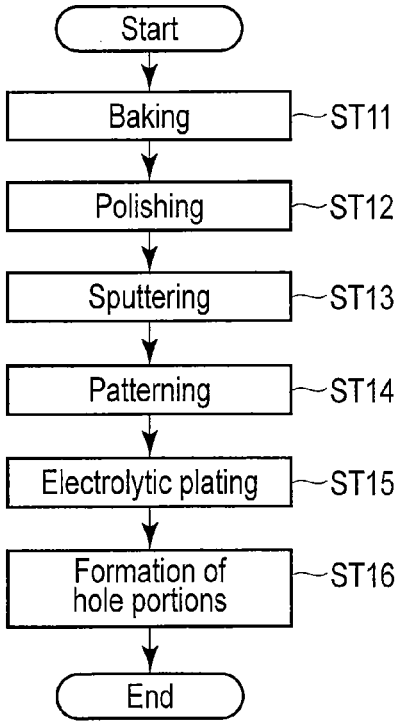
FIG. 8 is a flowchart showing an example of the manufacture of the inkjet head.
Figure 9:
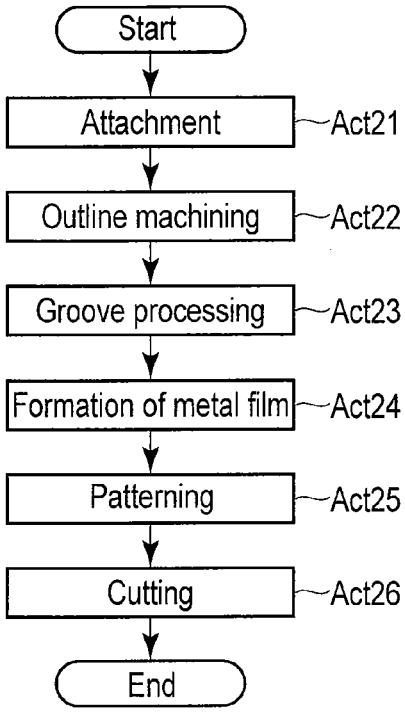
FIG. 9 is a flowchart showing an example of the manufacture of the inkjet head.
Figure 10:
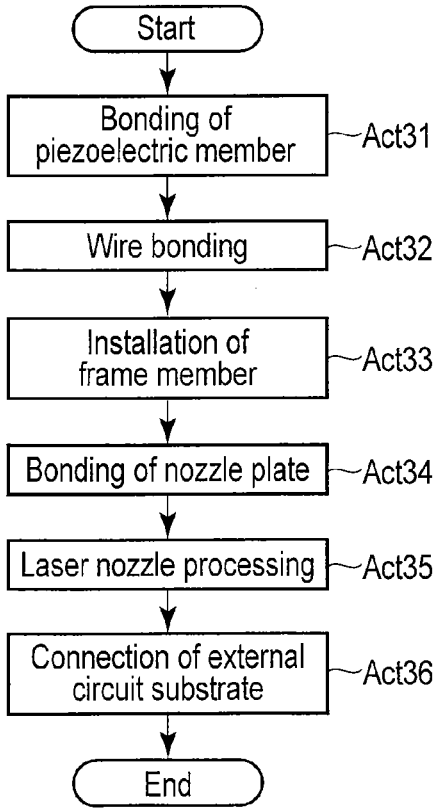
FIG. 10 is a flowchart showing an example of the manufacture of the inkjet head.

Furthermore, FIG. 5 to FIG. 7 are perspective views each schematically showing respective constituent elements in a step in manufacture of the inkjet head 1, FIG. 8 is a flowchart showing an example of steps in manufacture of a substrate 10 in the inkjet head 1, FIG. 9 is a flowchart showing an example of steps in manufacture of the piezoelectric member 13, and FIG. 10 is a flowchart showing an example of steps in manufacture of the inkjet head 1.

The inkjet head 1 according to this embodiment is used for an output apparatus such as an inkjet recording apparatus that discharges liquid drops to a sheet type recording medium such as a paper sheet to print symbols or images on the recording medium.

Figure 2:
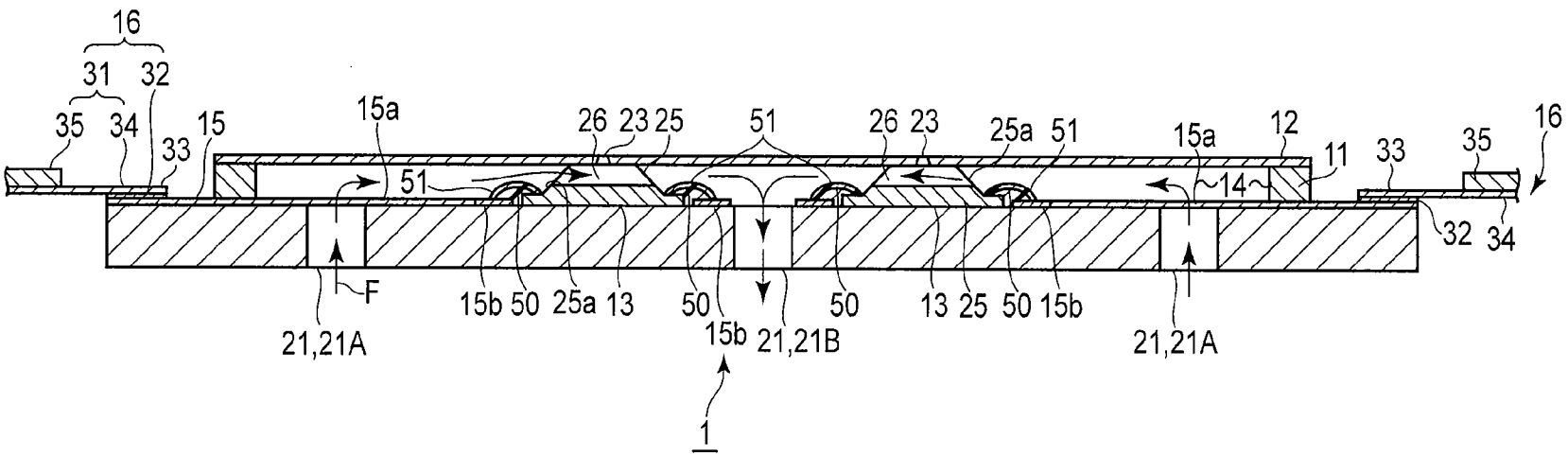
FIG. 2 is a cross-sectional view showing primary structures of the inkjet head.
Figure 3:
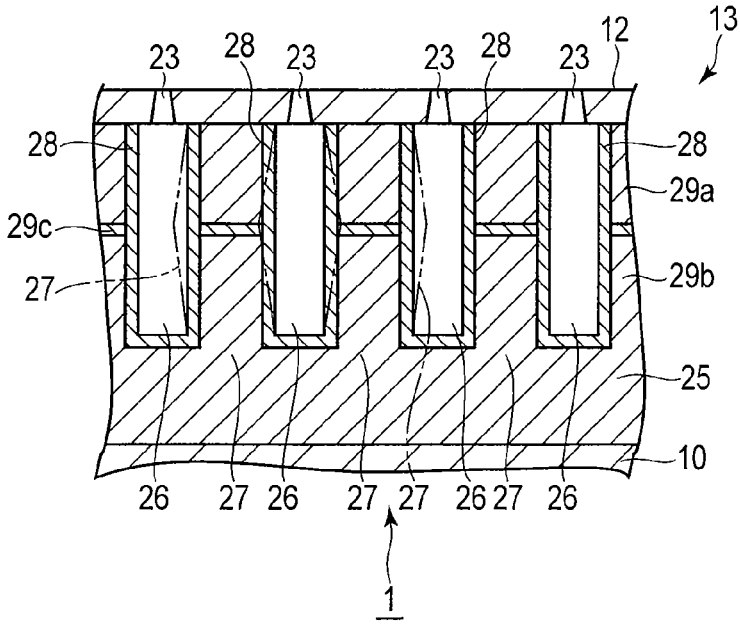
FIG. 3 is a cross-sectional view showing the primary structures of the inkjet head.
Figure 4:
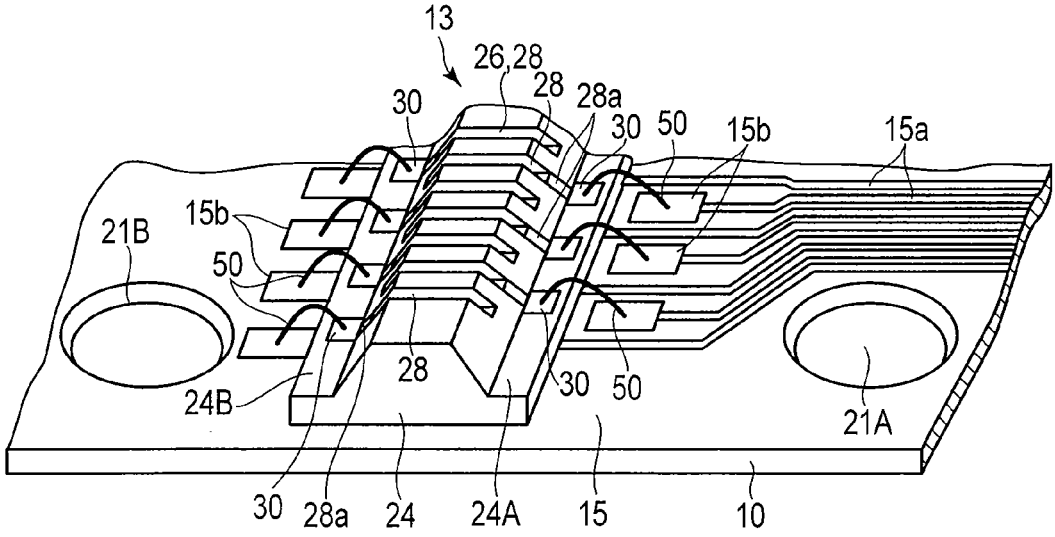
FIG. 4 is a perspective view showing the primary structures of the inkjet head.

As shown in FIG. 1 to FIG. 3, the inkjet head 1 comprises a substrate 10, a frame member 11, a nozzle plate 12, piezoelectric members 13, a common liquid chamber 14, wiring circuits 15, and driver circuit substrates 16.

The substrate 10 is formed into a square plate shape by using, e.g., a ceramics material. It should be noted that the ceramics material used for the substrate 10 is equal to a ceramics material used for the piezoelectric members, or it has a thermal expansion coefficient close to that of the ceramics material used for the piezoelectric members 13. Specifically, the substrate 10 is formed of a baked and polished alumina flat plate.

Hole portions 21 pierced to extend between main surfaces are provided in the substrate 10. It should be noted that these hole portions 21 are arranged in three rows along the longitudinal direction, and the hole portions 21 in two rows at both ends are supply openings 21A. The hole portions 21 in one row at the center are discharge openings 21B.

The frame member 11 is bonded to one main surface of the substrate 10. The frame member 11 is formed into a shape that at least surrounds the hole portions 21 provided in the substrate 10.

The nozzle plate 12 is bonded to the upper surfaces of the frame member 11 and the piezoelectric members 13 and covers the opened upper surface of the frame member 11. The nozzle plate 12 is formed of a square polyimide film. The nozzle plate 12 has a pair of (two) nozzle rows 22. Each nozzle row 22 has nozzles 23.

As shown in FIG. 1 to FIG. 3, the piezoelectric members 13 are bonded to the main surface of the substrate 10 on the inner side of the frame member 11. In more detail, each piezoelectric member 13 is made of, e.g., PZT (piezoelectric zirconate titanate). Each piezoelectric member 13 comprises a plate-like flange 24 and a piezoelectric portion 25 provided on the flange 24.

The piezoelectric portion 25 has inclined surfaces 25*a* on side surfaces thereof and has a cross section formed into a trapezoidal shape. As shown in FIG. 3, the piezoelectric portion 25 has pressure chambers 26 each having a groove-like surface formed by cutting, sidewalls 27 provided on both side portions of each pressure chamber 26, electrodes 28 formed on surfaces of the sidewalls 27 and bottoms of the pressure chambers 26, and electrode wiring lines 28*a* connected to the electrodes 28.

One pair of electrode members 13 are provided, and they are extended between the supply openings 21A and the discharge openings 21B along the nozzle rows 22 of the nozzle plate 12. Additionally, the piezoelectric members 13 are arranged in such a manner that each pressure chamber 26 faces each nozzle 23. The flange 24 protrudes along both side ends of the piezoelectric portion 25. Specifically, the flange 24 has a protruding portion 24A protruding from one side end of the piezoelectric portion 25 and a protruding portion 24B protruding from the other end side of the piezoelectric portion 25. The flange 24 comprises on the protruding portions 24A and 24B electrode pads 30 connected to the electrode wiring lines 28*a* continuous with the electrodes 28, respectively. It should be noted that the electrode pads 30 on the protruding portions 24A and 24B are alternately connected to the electrode wiring lines 28*a*.

As shown in FIG. 3 and FIG. 5, the piezoelectric portion 25 is formed by arranging piezoelectric plates 29*a* and 29*b* to face each other so that their polarizing directions are opposite to each other and attaching these plates through an adhesive layer 29*c* such as an adhesive. Additionally, as shown in FIG. 4, the electrode wiring lines 28*a* that connect the electrodes 28 to the electrode pads 30 are formed on the inclination surfaces 25*a* of the piezoelectric portion 25. It should be noted that the electrode wiring lines 28*a* are formed on the inclined surface 25*a* on the protruding portion 24A or protruding portion 24B side where the electrode pads 30 connected with end portions of these wiring lines 28*a* are provided.

The number of the electrode wiring lines 28*a* and the number of the electrode pads 30 are equal to the number of the pressure chambers 26. Further, the electrode wiring lines 28*a* and the electrode pads 30 are alternately provided on either side of the inclined surfaces 25*a* and the protruding portions 24A and 24B placed on both end sides of the pressure chambers 26. As a result, one electrode wiring line 28*a* and one electrode pad 30 are arranged on an end side of the pressure chamber 30 different from an end side where the electrode wiring line 28*a* and the electrode pad 30 connected to an adjacent pressure chamber 26 are arranged.

That is, the electrode wiring lines 28*a* and the electrode pads 30 are alternately provided to sandwich the pressure chambers 26 in such a manner that the wiring lines 28*a* and the electrode pads 30 are not placed next to the electrode wiring lines 28*a* and the electrode pads 30 adjacent thereto.

In other words, as shown in FIG. 4, the electrode wiring line 28*a* and the electrode pad 30 associated with one of the pressure chambers 26 are provided on the upper surface of the protruding portion 24A and the inclined surface 25*a* continuous with the protruding portion 24A. Further, the electrode wiring line 28*a* and the electrode pad 30 associated with the pressure chamber 26 adjacent to the former pressure chamber 26 are provided on the upper surface of the protruding portion 24B and the inclined surface 25*a* continuous with the protruding portion 24B.

As described above, the electrode wiring line 28*a* and the electrode pad 30 are connected with one of both the end sides of the pressure chamber 26 different from the end side where the electrode wiring line 28*a* and the electrode pad 30 connected with the adjacent pressure chamber 26 are provided.

In such a piezoelectric member 13, the electrode pads 30 are electrically connected to the wiring circuit 15 through bonding wires (wires) 50 connected by a wire bonding method. Furthermore, in each piezoelectric member 13, the electrode pads 30 and the bonding wires 50 are sealed by a sealing resin 51.

As shown in FIG. 2, the pressure chambers 26 are placed in the common liquid chamber 14. The pressure chambers 26 are configured to emit a liquid from the nozzles 23 by increasing a pressure of the liquid (an ink) in this common liquid chamber 14.

This pressure chamber 26 is formed in such a manner that its volume can be expanded when the sidewalls 27 are laterally moved as indicated by a line of alternate long and two short dashes in FIG. 3 by electric power supplied from the electrodes 28. Moreover, the volume of the pressure chamber 26 can be reduced by restoring the sidewalls 27 to an upright state which is an initial position as indicated by a solid line in FIG. 3 after expansion of the volume. The pressure chamber 26 reduces its volume after expansion to increase a pressure of the liquid placed in the pressure chamber 26, thereby discharging the liquid from the nozzle 23.

The common liquid chamber 14 is formed in a space surrounded by the substrate 10, the frame member 11, and the nozzle plate 12. The common liquid chamber 14 communicates with the supply openings 21A and the discharge openings 21B through the pressure chambers 26.

As shown in FIG. 1, FIG. 2, and FIG. 4, the wiring circuits 15 are formed to enable the electrodes 28 of the piezoelectric members 13 and the driver circuit substrates 16 to connect to each other. That is, each wiring circuit 15 is an aggregate of wiring lines 15*a* that connect the driver circuit substrate 16 to the respective electrodes 28. The wiring line 15*a* is arranged to avoid each supply opening 21A and has an electrode pad 15*b* at its end portion.

For example, in regard to how to form the wiring circuit 15, a Cr film configured on the substrate 10 by sputtering is formed into a predetermined wiring pattern by using a subtractive method. Then, an Au film is formed on the Cr wiring pattern by an electrolytic plating method. As a result, the wiring lines 15*a* and the electrode pads 15*b* are formed on the substrate 10. In the wiring circuit 15, the electrode pads 15*b* are connected with the electrode pads 30 of the piezoelectric member 13 through the bonding wires 50.

Some of the wiring lines 15*a* cut across a bonding area 13A which is the range on the substrate 10 where the piezoelectric member 13 is bonded. Specifically, the wiring lines 15*a* are provided to cut across the bonding area 13A on the substrate 10 where the piezoelectric member 13 is bonded in such a manner that one of each pair of alternately arranged wiring lines 15*a* in the wiring lines 15*a* provided in parallel is adjacent to the electrode pad 30 to be connected. Each electrode pad 15*b* is arranged in proximity to the piezoelectric pad 30 on the substrate 10 when the piezoelectric member 13 is bonded to the bonding area 13A.

The driver circuit substrate 16 is a printed circuit board configured to drive each piezoelectric member 13, and it is an external circuit substrate connected to an external device such as a control unit of a printer. For example, the driver circuit substrate 16 comprises a tape carrier package (TCP) 31 and an anisotropic conductive film (ACF) 32.

In the driver circuit substrate 16, when the ACF 32 is subjected to thermocompression bonding, the TCP 31 is joined and connected (mounted) to the substrate 10.

The TCP 31 comprises a tape-like resin film 34 and an IC chip 35 which is a drive IC of the piezoelectric member 13. Furthermore, the TCP 31 comprises on the resin film 34 a wiring circuit 36 patterned from the IC chip 35 to its terminal potion 33.

The IC chip 35 of such a driver circuit substrate 16 is connected to each electrode 28 of the piezoelectric member 13 through the wiring circuit 36, the ACF 32, and the wiring circuit 15. Furthermore, the TCP 31 is connected to, e.g., a printed substrate provided to the external device such as a control unit of the printer.

The thus configured inkjet head 1 is mounted in the printer and connected to an ink tank. The liquid is circulated between the inkjet head 1 and the ink tank, and print processing is carried out by using a part of the circulated ink. It should be noted that an arrowhead F in FIG. 2 represents a flow of the liquid.

Specifically, as indicated by the liquid flow F in FIG. 2, the liquid is supplied from the ink tank of the printer to the common liquid chamber 14 of the inkjet head 1 through the supply openings 21A. The liquid supplied to the inside of the common liquid chamber 14 passes through the respective pressure chambers 26, and the liquid is discharged from the discharge openings 21B.

It should be noted that, when a user instructs the printer to print symbols or images, the control unit of the printer transmits a print signal to each. IC chip 35 based on the print information in order to discharge liquid drops from the corresponding nozzle 23.

The print IC chip 35 that has received this print signal applies a drive pulse voltage to the electrodes 28 of the corresponding pressure chamber 26 through the wiring circuits 15 and 36. As shown in FIG. 3, based on the application of the pulse voltage to the electrodes 28, the pair of left and right sidewalls 27 of this pressure chamber 26 undergo share mode deformation to bend and recede from each other, thereby expanding the volume of the pressure chamber 26.

Then, the sidewalls 27 are restored to the initial position to reduce the volume of the pressure chamber 26 and to increase a pressure of the liquid in the pressure chamber 26, whereby the liquid is emitted from the nozzle 23.

A manufacturing method of the inkjet head 1 will now be described with reference to FIG. 1 to FIG. 10. A manufacturing method of the substrate 10 will be first explained with reference to a flowchart of FIG. 8.

A tabular ceramic plate made of alumina is first baked (Act 11). Then, the baked ceramic plate is polished (Act 12).

Subsequently, a metal film, which is a Cr film in this example, is formed on a surface of the ceramic plate on which each wiring circuit 15 is to be formed (Act 13).

Then, the Cr film is patterned into shapes of each wiring line 15*a* and each electrode pad 15*b* (Act 14). As a patterning technique, for example, a subtractive method is used. As shown in FIG. 7, the wiring lines 15*a* are provided to alternately reach positions adjacent to the protruding portions 24A and 24B of the piezoelectric member 13, respectively. In other words, as shown in FIG. 7, the wiring liens 15*a* are formed into a pattern that they alternately cut across the bonding area 13A of the piezoelectric member 13.

Further, the wiring lines 15*a* are provided to avoid portions where the hole portions 21 are formed at a later step. The wiring line 15*a* is formed in such a manner that each of a width thereof and an interval between itself and an adjacent wiring line 15*a* is approximately 20 μm. Furthermore, a square pattern of 60×100 μm is formed at the end portion (a terminal) of the wiring line 15*a* as the electrode pad 15*b*.

Then, an Au film is formed on the patterned Cr film by an electrolytic plating method (Act 15). At last, the hole portions 21 are formed by, e.g., an ultrasonic machining method. Based on these steps, the substrate 10 is manufactured.

A manufacturing method of the piezoelectric member 13 will now be described with reference to a flowchart of FIG. 9.

First, as indicated by a line of alternate long and two short dashes in FIG. 5, the piezoelectric plates 29*a* and 29*b* are arranged in such a manner that their polarizing directions are opposite to each other, and the adhesive layer 29*c* is provided between the piezoelectric plates 29*a* and 29*b* to attach the piezoelectric plates 29*a* and 29*b* to each other. A piezoelectric material 41 which is a material of the piezoelectric member 13 is formed by attaching the piezoelectric plates 29*a* and 29*b* to each other (Act 21). It should be noted that, as each of the piezoelectric plates 29*a* and 29*b*, one having a size that enables forming the multiple piezoelectric members 13 is used.

Subsequently, as shown in FIG. 5, outline machining of the attached piezoelectric plates 29*a* and 29*b* (the piezoelectric material 41) is carried out by cutting work using, e.g., a milling machine or a cutting machine (Act 22). Specifically, the outline of the piezoelectric portion 25 is formed with the continuous flange 24 by the cutting work using, e.g., the milling machine or the cutting machine. For example, each inclined surface 25*a* that is inclined at 45 degrees from the main surface direction while having a difference of 0.6 mm between the upper surface of the flange 24 and the upper surface of the piezoelectric portion 25.

Then, as shown in FIG. 6, grooves 42, each of which is deeper than the adhesive layer 29*c* and connects the inclined surfaces 25*a* to each other, are formed in the piezoelectric material 41 in parallel to each other by using a diamond plate for dicing (Act 23). It should be noted that the adhesive layer 29*c* is designated by a line of alternate long and two short dashes in FIG. 6.

Subsequently, a metal film 43 is formed on the entire surface of the piezoelectric material 41 (Act 24). This metal film 43 is, e.g., a plated layer. As formation of such a plated layer 43, an Ni film is first formed on outer surfaces the substrate 10 and the piezoelectric material 41 by a nonelectrolytic plating method. Thereafter, an Au film is formed on the outer surfaces of the substrate 10 and the piezoelectric material 41 by an electrolytic plating method, thereby forming the plated layer 43.

Then, the plated layer 43 is pattered by using a laser beam based on, e.g., a laser patterning method to process the electrodes 28, the electrode wiring lines 28*a*, and the electrode pads 30 (Act 25).

Specifically, to electrically insulate the neighboring grooves 42 from each other, each space between the grooves 42 is irradiated with the laser beam to remove the unnecessary plated layer 43 on the piezoelectric material 41. As a result, the electrodes 28 are formed in the grooves 42, and each groove 42 having the electrodes 28 formed of the plated layer 43 functions as the pressure chamber 26.

Furthermore, each electrode wiring line 28*a* that connects the electrode 28 to the flange 24 is formed on the inclined surface 25*a* and each electrode pad 30 is formed at the end portion of the electrode wiring line 28*a* on the flange 24 simultaneously with the removal of the plated layer 43 on the piezoelectric material 41. The electrode wiring lines 28*a* and the electrode pads 30 continuous with the electrodes 28 adjacent to each other are alternately arranged so that they are arranged on different inclined surfaces 25*a* and the protruding portions 24A and 24B of the flange 24.

In other words, the electrode wiring line 28*a* and the electrode pad 30 are provided to a given electrode 28 at positions corresponding to one inclined surface 25*a* and the protruding portion 24A of the flange 24. The electrode wiring line 28*a* and the electrode pad 30 provided to the electrode 28 adjacent to the former electrode 28 are provided on the other inclined surface 25*a* and the other protruding portion 24B.

As described above, the electrode wiring lines 28*a* and the electrode pads 30 provided to the electrodes 28 adjacent to each other are provided on the different sides. It should be noted that each electrode pad 30 is formed into a shape of, e.g., 60×100 μm.

Removing the unnecessary plated layer 43 formed on the piezoelectric material 41, the inclined surfaces 25*a* and the flange 24 in this manner enables constituting the piezoelectric member 13.

Subsequently, the piezoelectric material 41 is cut together with the piezoelectric member 13 into each piece (Act 26). It should be noted that the piezoelectric material 41 is cut based on dicing using, e.g., a dicing blade. Based on these steps, the piezoelectric member 13 is manufactured.

A manufacturing method of the inkjet head 1 using the manufactured substrate 10 and piezoelectric member 13 will now be described with reference to a flowchart of FIG. 10.

First, as shown in FIG. 7, each piezoelectric member 13 is bonded to the upper side of the substrate 10 (Act 31). For example, the piezoelectric member 13 is pressure-bonded in the bonding area 13A on the substrate 10 to interpose an insulating adhesive therebetween.

Then, each electrode pad 30 of the piezoelectric member 13 is connected to each electrode pad 15*b* of the wiring circuit 15 through a wiring line based on the wire bonding method (Act 32). Specifically, as shown in FIG. 2 and FIG. 4, the electrode pads 15*b* and 30 are connected to each other based on bonding using, e.g., a metal bonding wire 50 made of an Au material. Subsequently, the connected bonding wire 50 and electrode pads 15*b* and 30 are sealed by using, e.g., a resin material having insulating properties like the sealing resin 51 depicted in FIG. 2.

Then, as shown in FIG. 1, the frame member 11 is disposed to the substrate 10 (Act 33). It should be noted that the frame member 11 is mounted on the wiring circuits 15 formed on the substrate 10, and it is bonded to the substrate 10.

Subsequently, the nozzle plate 12 is bonded to the upper surface of the frame member 11 and the upper surface of the piezoelectric member 13 to close the opening of the frame member 11 (Act 34). Then, the nozzles 23 are formed at positions in the nozzle plate 12 facing the pressure chambers 26 by, e.g., a laser machining method. (Act 35).

At last, the driver circuit substrate 16 is connected to the substrate 16 (Act 36). Specifically, each TCP 31 is connected to the wiring circuit 15 through the ACF 32, and each IC chip 35 is thereby connected to each electrode 28 of the piezoelectric member 13 through the wiring circuit 15. Based on these steps, the inkjet head 1 is manufactured.

According to the thus configured inkjet head 1, the electrode pads 30 connected to the respective electrodes 28 of the pressure chambers 26 can be alternately arranged on the different end sides of the pressure chambers 26, thereby increasing a distance between the electrode pads 30 adjacent to each other. Likewise, a distance between the electrode pad 30 and the electrode pad 15*b* connected thereto can be increased. Since the distance between the electrode pad 30 and the electrode pad 15*b* connected thereto can be increased, a wiring interval between the wiring lines 15*a* and 28*a* connected to the electrode pads 15*b* and 30 can be reduced.

Giving a detailed description, there is known that an optical technique that is application of a photolithography technology such as a laser patterning method or a subtractive method is used as a technique of forming the wiring line 15*a* of the wiring circuit 15 and the wiring line 28*a* of the piezoelectric member 13. However, when the optical technique is used with respect to a surface having a difference in height, e.g., the substrate and the piezoelectric member joined and connected to each other, an exposed state differs depending on each height due to diffusion of light. That is, since a processing width differs because of a difference in height, assuredly forming highly dense wiring lines is difficult, and miniaturization of the wiring lines is also difficult.

However, in this embodiment, as a method of manufacturing the inkjet head 1, the wiring lines 15*a* and 28*a* and the electrode pads 15*b* and 30 are first formed on the substrate 10 and each piezoelectric member 13 to be connected with the electrodes 28 on the different end sides of the pressure chambers 26. Then, the substrate 10 and each piezoelectric member 13 are joined and connected to each other by using the wire bonding method.

When the inkjet head 1 according to this embodiment is manufactured by using such steps, the wiring lines 15*a* adjacent to each other can be processed on the flat substrate 10 having no difference in height. Further, the wiring lines 28*a* are alternately provided on the different end sides of the pressure chambers 26, thereby assuring a wide processing width between the wiring lines 28*a* adjacent to each other (a distance between the wiring lines 28*a*). Therefore, the wiring lines 15*a* and 28*a* can be assuredly formed, thus improving certainty of the processing.

Spaces between the wiring lines 15*a* and between the wiring lines 28 can be further miniaturized by using the manufacturing method of forming the respective wiring lines 15*a* and 28*a* to be alternately placed on the different end sides of the pressure chambers 26 on the substrate 10 with a difference in height and each piezoelectric member 13 and then connecting these wiring lines 15*a* and 28*a*. As a result, the wiring lines 15*a* and 28*a* can be highly densely formed.

Therefore, even if the spaces between the pressure chambers 26 are further narrowed, the adjacent wiring lines 28*a* and the adjacent electrode pads 30 can be prevented from interfering with each other, thereby realizing high density of alignment of the pressure chambers 26. As a result, gaps between the nozzles 23 can be reduced. Consequently, high definition of printing can be realized by the inkjet head 1.

As described above, according to the inkjet head 1 of this embodiment, high density of alignment of the pressure chambers 26 can be achieved by providing the electrode pads 30 connected to the adjacent electrodes 28 in each piezoelectric member 13 and the electrode pads 15*b* of the wiring circuit 15 connected with the electrode pads 30 to be alternately placed on the different end sides of the pressure chambers 26. As a result, high definition of printing can be realized by the inkjet head 1.

The present embodiment is not limited to the above embodiment. For example, although the configuration of forming the metal film 43 on the entire surface of the piezoelectric element 41 in manufacture of the piezoelectric member 13 has been described in the above embodiment, but the present embodiment is not limited thereto. For example, it is possible to adopt a configuration that a resist material such as a polyester film is provided on a lower surface of the joined substrate 10 and the metal film 43 is not formed on the lower surface of the substrate 10.

Further, although the configuration that the plated layer 43 is patterned by the laser beam based on the laser patterning method to process the electrodes 28, the electrode wiring lines 28*a*, and the electrode pads 30 has been described in the foregoing embodiment, the present embodiment is not limited thereto. For example, the subtractive method may be used in place of the laser patterning method to process the electrodes 28, the electrode wiring lines 28*a*, and the electrode pads 30. Moreover, it is possible to adopt a lift-off method of forming a photoresist on a position except positions of the electrodes 28, the electrode wiring lines 28, and the electrode pads 30, then sputtering the metal film, and delaminating the photoresist in place of the subtractive method.

Additionally, in regard to the wiring circuit 15, the configuration that the Cr film configured on the substrate 10 is formed into a predetermined wiring pattern and then the Au film is formed on the Cr wiring pattern by the electrolytic plating method in the above embodiment, but the present embodiment is not restricted thereto. For example, the metal material used for forming the film on the substrate 10 may be an alloy of Cr and Cu or an alloy of Cr and Ni in place of Cr.

Further, for example, it is possible to adopt a configuration that 1000 Å of Cr is sputtered on the substrate 10, then 4000 Å of Au is sputtered on the Cr film, and the formed Cr film and Au film are formed into a desired wiring pattern by the subtractive method. In this case, electrolytic Au plating is not required.

Furthermore, although the piezoelectric member 13 is formed by using the method of arranging and bonding the two piezoelectric plates 29*a* and 29*b* and then forming the inclined surfaces 25*a* and the flange 24 by cutting work in the above embodiment, the present embodiment is not limited thereto. For example, the two piezoelectric plates 29*a* and 29*b* may be bonded, the inclined surfaces 25*a* alone are provided with a trapezoidal cross-sectional shape, and then a different plate-like member may be bonded to form the flange 24.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a nozzle plate comprising nozzles;

a piezoelectric member which comprises pressure chambers each associated with one of the nozzles, sidewalls which pressurize the pressure chambers, electrodes formed on the sidewalls, and electrode wiring lines each connected to one of the electrodes and each provided on one of the pressure chambers, the electrode wiring lines being alternately provided on the pressure chambers such that every other electrode wiring line is provided on a first side of the pressure chambers and every other remaining electrode wiring line is provided on a second side of the pressure chambers which is different from the first side of the pressure chambers, the pressure chambers being pressurized by applying a drive pulse voltage to the sidewalls from the electrodes, thereby discharging a liquid from the nozzles;

a substrate to which the piezoelectric member is bonded;

a frame member which is bonded to the substrate and the nozzle plate and surrounds the piezoelectric member to form a liquid chamber from which liquid is supplied to the pressure chambers; and a wiring circuit which is provided on the substrate and comprises wiring lines connected with the electrode wiring lines, respectively, wherein, in the wiring circuit, every other wiring line is arranged on the substrate extending across an area where the piezoelectric member is bonded to the substrate, and the wiring lines that extend across the area where the piezoelectric member is bonded are connected to the every other electrode wiring lines that are provided on the first side of the pressure chambers, and wherein the piezoelectric member, the nozzle plate, the substrate, and the frame member constitute a roof-shooter type configuration.

2. The inkjet head according to claim 1, further comprising first electrode pads formed at end portions of the electrode wiring lines and second electrode pads formed at end portions of the wiring lines; and bonding wires that connect the first electrode pads to the second electrode pads.

* * * * *